United States Patent [19]

Ajus et al.

[11] Patent Number: 4,856,196

[45] Date of Patent: Aug. 15, 1989

[54] METHOD AND DEVICE FOR CONSTRUCTING SLEEVES

[76] Inventors: Camille A. Ajus; Marguerite H. Ajus, both of 831 St. Aubin, Ville St. Laurent, P.Q., Canada, H4M 1J9

[21] Appl. No.: 109,539

[22] Filed: Oct. 19, 1987

[30] Foreign Application Priority Data

Oct. 29, 1986 [CA] Canada ..... 521766

[51] Int. Cl.[4] ..... A41H 3/00

[52] U.S. Cl. ..... 33/17 R; 33/11

[58] Field of Search ..... 33/11, 12, 13, 14, 17 R, 33/17 A

[56] References Cited

U.S. PATENT DOCUMENTS

| | | | |
|---|---|---|---|
| 3,898 | 1/1845 | Woodcock . | |
| 325,409 | 9/1985 | Hendrick . | |
| 1,011,915 | 12/1911 | Carbonara . | |
| 1,160,863 | 11/1915 | Girard | 33/11 |
| 1,204,900 | 11/1916 | Picken . | |
| 1,625,453 | 4/1927 | Capuano . | |
| 3,369,300 | 2/1968 | Green . | |
| 3,911,584 | 10/1975 | Ajus et al. | 33/11 |
| 4,542,586 | 9/1985 | Hori | 33/17 R |
| 4,565,006 | 1/1986 | Vouyouka | 33/11 |
| 4,672,748 | 6/1987 | Perazzolo | 33/11 |

FOREIGN PATENT DOCUMENTS

| | | | |
|---|---|---|---|
| 81426 | 1/1970 | Brazil . | |
| 3700922 | 8/1978 | Brazil . | |
| 7704709 | 1/1979 | Brazil . | |
| 499712 | 11/1954 | Italy . | |
| 556646 | 2/1957 | Italy . | |
| 612273 | 11/1960 | Italy . | |
| 615306 | 1/1961 | Italy . | |
| 185880 | 7/1981 | Italy . | |
| 9896 | of 1889 | United Kingdom . | |
| 701043 | 12/1953 | United Kingdom | 33/11 |
| 845319 | 8/1960 | United Kingdom . | |

*Primary Examiner*—William A. Cuchlinski, Jr.
*Assistant Examiner*—Thomas B. Will
*Attorney, Agent, or Firm*—McFadden,Fincham,Marcus & Allen

[57] ABSTRACT

There is disclosed a garment drafting device which includes curves meeting certain equations which facilitate the design and creation of garments. In addition, there are disclosed methods for preparing sleeves which are an improvement over the art, and which facilitate the steps of creating the sleeves. Different sleeves may be created. In the garment drafting device, the creation of a new type of curve provides a device for readily obtaining the required curvature for patterns and the like.

15 Claims, 12 Drawing Sheets

METHOD AND DEVICE FOR CONSTRUCTING SLEEVES

This invention relates in one aspect to a method of constructing sleeves for garments.

In a still further aspect, this invention relates to a template or the like device for carrying out the above method.

There are several known techniques for constructing various portions of a garment. Briefly, amongst the references known are Brazil Design Patent No. 3700922 of Aug. 8, 1978 which discloses a template with several cut-outs for engineering unspecified garment features; this reference does not, however, appear to disclose any specific method or template for designing a sleeve which the present, application is concerned with. In addition, there are no specific curves provided for the design of tailored sleeves or the like.

U.S. Pat. No. 9,702 to Oswaldo discloses a template which utilizes a triangular form with three cut-outs and a large curve on the hypotenuse; this does not disclose any means to draw sleeve curves for both the front and back of the sleeve in a single step. It does not further include any means to design different types of tailored sleeves and it is not believed that this would be susceptible to industrial application. Likewise, U.S. Pat. No. 205,660 to Circulo Familiar Ltd. discloses a device made up of two rectangular templates which do not include any features to permit the design of sleeves for the reasons given with respect to the above patents Italian Pat. No. 615,306 to E. Razzoni of Jan. 14, 1961 illustrates a device which does not design the sleeve cap or the front and back of a sleeve in a single operation. It has no means to develop tailored sleeves either generally or specifically for given applications, nor are there means to design the armhole for a sleeve without the use of a basic dart and there is no method disclosed for making this possible.

British Pat. Nos. 9896; 325,409; 845,319; 1,204,900; and 21408 are further examples of the prior art which all lack features permitting the creation of tailored sleeves and as well, lack the features described above with respect to the other references. Generally speaking, these references do not teach any method of tracing tailored sleeves, independently of their style, and again, these references fail to disclose any system for preparing sleeve curves, both the front and back, in a single step.

U.S. Pat. No. 1,011,915 to P. Carbonara discloses in FIG. 4 design means for forming a sleeve. However, this reference only designs a frame which then utilizes references known to the author to match a garment which the author is designing. There are thus no means to design a sleeve cap, or an open or closed sleeve, which one would have to rely on ones experience for.

U.S. Pat. No. 3,911,584 discloses a construction of sleeve curves based on allowing the curve to assume different configurations. However, this reference is fairly complicated and does not generally permit a user to create a sleeve design in a single step combined with the sleeve cap.

The purpose of the present invention is to provide a simpler method of constructing a sleeve with variations in the construction of the sleeve to permit accommodation of different styles. More particularly in accordance with one method of the aspect, there is provided an improvement in a method of constructing a sleeve in which an elbow dart is formed inwardly spaced from a side longitudinal line of a length of elongated material having an inclined lower sleeve width at one end thereof, the improvement characterized by:

(i) forming a dart at said apex wherein the arms of said dart form a substantially right angle with
  (a) a line intersecting said apex on said side longitudinal line at the rear sleeve cap and
  (b) said inclined lower sleeve width,
(ii) determining the mounting point of a sleeve underarm seam to a front armhole of a garment,
(iii) forming an underarm sleeve width so as to have a width of said material projecting beyond said side longitudinal edge approximately equal to the width of said sleeve width less a distance approximately equal to said mounting point of the sleeve underarm seam with a garment and a side seam of a garment,
(iv) forming an arcuate rear sleeve head between said mounting point of said step (ii) and a seam of the sleeve,
(v) increasing the length of said width of the sleeve at the side opposed to that of step (iv) a distance approximately equal to the length of the mounting point of the sleeve underarm seam to a front armhole of a garment and the side seam of a garment, and
(vi) forming an arcuate front sleeve head adapted to meet the rear sleeve head of said sleeve material when the material is joined together.

In a preferred form of the invention, the improvement is used in a method of forming a sleeve which includes the steps of:

(1) providing a length of elongated material,
(2) determining a side longitudinal line of said material,
(3) determining a given armhole depth,
(4) determining the width of the sleeve,
(5) determining the approximate longitudinal centre relative to the side longitudinal line of the material for a sleeve,
(6) determining approximately on said side longitudinal centre line the depth of a sleeve cap,
(7) forming a generally arcuately shaped rear sleeve cap outline,
(8) determining on the sleeve cap the mounting point of the sleeve to a shoulder of a garment,
(9) forming a general arcuately shaped front sleeve cap outline,
(10) determining a given elbow length transversely of said material below said armhole,
(11) forming an inwardly spaced apex point of an elbow dart from said side longitudinal line, and
(12) forming an inclined lower sleeve width at one end of said material, the improvement characterized by:

(i) forming a dart at said apex wherein the arms of said dart form a substantially right angle with
  (a) a line intersecting said apex on said side longitudinal line at the rear sleeve cap and
  (b) said inclined lower sleeve width,
(ii) determining the mounting point of a sleeve underarm seam to a front armhole of a garment,
(iii) forming an underarm sleeve width so as to have a width of said material projecting beyond said side longitudinal edge approximately equal to the width of said sleeve width less a distance approximately equal to said mounting point of the sleeve underarm seam with a garment and a side seam of a garment, (iv) forming an arcuate rear sleeve head between said mounting point of said step (ii) and a seam of the sleeve, (v) increasing the length of said width of the sleeve at the side opposed to that of step (iv) a distance approximately equal to the length of the mounting point of the sleeve underarm seam to a front armhole of a garment and the side seam of a garment, and (vi) forming an arcuate front sleeve head adapted to meet the rear sleeve head of said sleeve material when the material is joined together.

In preferred embodiments, the above method is carried out by forming a line projecting beyond the side longitudinal line on the rear sleeve cap at substantially right-angles to a line intersecting the apex and a point at the side longitudinal edge of the rear sleeve cap.

Another preferred embodiment is one in which the step of forming an inclined lower sleeve width is carried out by forming a width substantially equal to the width of the sleeve by the desired angle of inclination.

A further feature in the step of forming a generally arcuately shaped rear sleeve cap outline is carried out by forming a line extending inwardly from the side longitudinal line to the upper part of the centre longitudinal line.

In a still further feature of the present invention, there is also provided a method of forming a sleeve which includes the steps of:

(1) providing a length of elongated material, (2) determining a centre line on said material, (3) determining a given armhole depth on a centre longitudinal line, (4) determining approximately the depth of the sleeve cap on the centre line, (5) determining approximately one-quarter the sleeve width from the longitudinal centre line, from the approximate sleevecap depth, of the centre line, (6) determining a sleeve width, (7) forming an arcuately shaped rear sleeve cap outline, (8) determining a mounting point of the sleeve to the shoulder of the garment, (9) providing on one side of said longitudinal centre line a horizontal line from the armhole depth previously determined on the longitudinal centre line,

(10) determining a position on the horizontal centre line of approximately one-half a sleeve width and optionally any allowance desired therefore and determining on a horizontal plane a point at about half the distance obtained to providing a second longitudinal line from the first point,

(11) providing, at approximately half the distance between the armhole depth and the cap depth previously defined on the centre longitudinal line, a horizontal line extending on both sides of the centre line,

(12) determining, on one side of the horizontal line, approximately one quarter of the sleeve width plus approximately the distance to accommodate the elbow shape of the body size for the garment,

(13) determining, on the opposite side of the centre line and on the same horizontal plane of step 12, approximately 75% of the sleeve width minus a distance equal to the distance added previously to accommodate the elbow shape for the body size of the garment,

(14) determining the elbow height and defining said height by a horizontal line extending on both sides of the longitudinal centre line,

(15) defining a sleeve length at the bottom of the longitudinal centre line by a horizontal line extending on both sides of the centre line,

(16) and optionally, on the horizontal lines at the bottom and the elbow line, determining approximately 25% the sleeve width, and

(17) determining a sleeve opening dimension on the bottom horizontal line, there is provided the improvement comprising;

(a) forming an arcuate rear sleeve head between said previously determined elements of steps (5) and (12) to thereby complete an arcuate-shaped rear sleeve cap outline described in step (7), (b) forming an arcuate front sleeve head between said mounting point of step (8) and the previously defined longitudinal line passing at approximately one-quarter of the sleeve width of step (10), (c) joining the point defined by step (13) and the arcuate line previously formed in step (a) by providing an arcuate line to form the underarm of a sleeve head, (d) determining approximately 75% of the sleeve width measure at the elbow horizontal line on the left side of the centre longitudinal line, (e) joining the underarm sleeve head described in step (c) to the sleeve opening of step (17) with a curved line passing said point on the elbow horizontal line step (d), (f) providing a curved line from the rear sleeve head of item (b) to the bottom sleeve opening determined on the right side of the longitudinal centre line, (g) providing a shape of the sleeve opening in an angle with the angle of the apex on the secondary longitudinal line of step (10), (h) determining approximately one half of the distance between the sleeve width and the second longitudinal line and providing a longitudinal curved line extending to the bottom of the sleeve opening and spaced at the elbow line or with its maximum curve at the elbow line, (i) next is nearer duplicating this longitudinal curved line provided in item (h), and (j) defining a two-piece tailored sleeve by the resulting contours and the longitudinal curved line of steps (h) and (i).

A still further embodiment in the step of determining approximately the depth of a sleeve cap is carried out by determining approximately one-third the length of the armhole depth.

In yet another embodiment the step of determining the width of the sleeve is carried out by determining one-half the length of an arm circumference and providing a predetermined allowance.

Still further, there is also provided a garment drafting device which includes curved defining means; this improved garment drafting device comprises a garment drafting device suitable for forming arcuate pattern outlines or the like, the device comprising a base material having at least one curve-defining means therein, the curve-defining means being selected from the group of those meeting the equation:

$$y = 6.1 + 0.54286x - 1.5 \sin\left[\frac{360}{\pi}(x + 0.75)\right], \quad (a)$$

wherein x has a value from 0 to 15, $$y=31.2913-27.4913x+10.6253x^2-1.9332x^3+0.18456x^4-8.9654*10^{-3}x^5+1.743*10^{-4}x^6, \quad (b)$$

wherein x has a value from 3 to 13.3, $$y=12.1238-5.5122x+1.2887x^2-0.1123x^3+3.277*10^{-3}x^4, \quad (c)$$

wherein x has a value of from 4 to 11.5, $$y=-2.95705+1.6279x-0.08334x^2, \quad (d)$$

wherein x has the value of from 7.8 to 13.5, $$y=12.9803-5.5719x+1.0685x^2-0.11236x^3+6.5767x^4\,10^{-3}-1.5968x^5\,10^{-4}, \quad (e)$$

wherein x has a value of from 2.9 to 13.5, and $$y=9.0697-3.3274x+0.32514x^2 \quad (f)$$

wherein x has a value of from 2.3 to 4.9.

Finally, this invention also provides a method of creating curves in a pattern or directly onto material by employing the garment drafting device described herein; in accordance with such a method, the garmenting drafting device may be used for providing the required curves on a pattern or length of material.

In each of the methods of the present invention, a more simplified form of preparing a sleeve is provided compared to the prior art; in addition, the garment drafting device with the curved defining means therein provides a very quick and expedient manner of creating portions of a tailored sleeve or the like which can be used for producing garments Another embodiment of the above method is carried out directly on a length of material adapted to form a sleeve.

A still further embodiment of the above method is carried out on a pattern adapted to overlay a length of sleeve material.

Having thus generally described the invention, reference will now be made to the accompanying drawings, illustrating preferred embodiments and in which.

Figure 20:
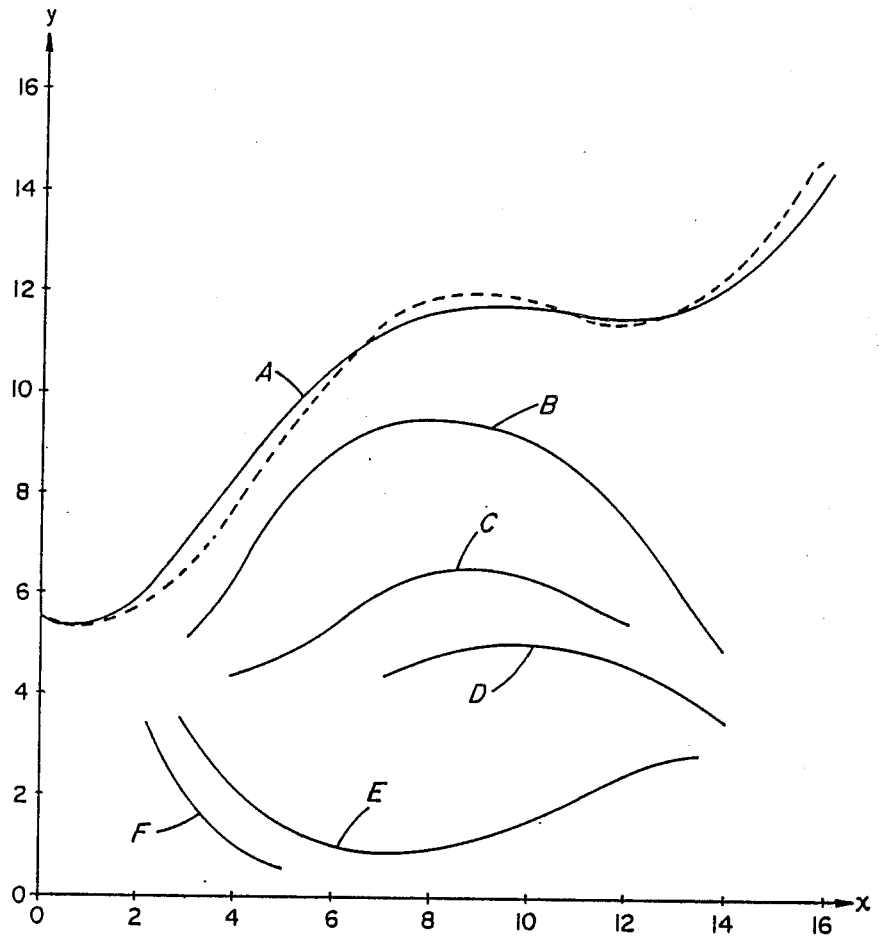

FIGS. 2-19 and 4A to 6A, 8A, 9A, 10A, 12A, 13A-14A 15A are diagrammatic sketches showing the method of the present invention as applied to either a length of material or a pattern which may be superimposed over a length of material; and FIG. 20 is a graph illustrating the equations for the curves used in the proceeding figures.

Referring initially to FIG. 20, the graph illustrates the various equations used, in accordance with this invention, in defining the different curves for the different parts of the garments or patterns to be created.

In greater detail, curve A meets the equation $$y = 6.1 + 0.54286x - 1.5 \sin\left[\frac{360}{\pi}(x + 0.75)\right],$$

wherein x has a value from 0 to 15,

Curve B conforms to the equation $$y=31.2913-27.4931x+10.6253x^2-1.9332x^2+0.18456x^4-8.9654*10^{-3}x^5+1.743*10^{-4}x^6,$$

wherein x is from 3 to 13.3.

Curve C meets the equation $$y=12.1238-5.5122x+1.2887x^2-0.1123x^3+3.277*10^{-3}x^4,$$

wherein x is from 4 to 11.5.

Curve D conforms to the equation $$y=-2.95705+1.6279x-0.08334x^2,$$

wherein x is from 7.8 to 13.5.

Curve E conforms to the equation $$y=12.9803-5.5719x+1.0685x^2-0.11236x^3+6.5767x^4 10^{-3}-1.5968x^5 10^{-4},$$

wherein x is from 2.9 to 13.5.

In addition, curve F meets the equation $$y=9.0697-3.3274x+0.32514x^2,$$

wherein x is from 2.3 to 4.9.

Curve A can also be expressed by the equation $$y=5.5-0.7747x+0.6882x^2-0.09798x^3+5.2016*10^{-3}x^4-9.0089*10^{-5}x^5,$$

wherein x is from 0 to 15. Both equations for curve A are treated equally herein and reference to one will be understood to include reference to the other, and vice-versa.

Figure 2:
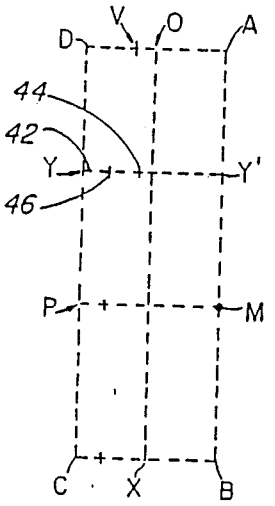
Figure 3:
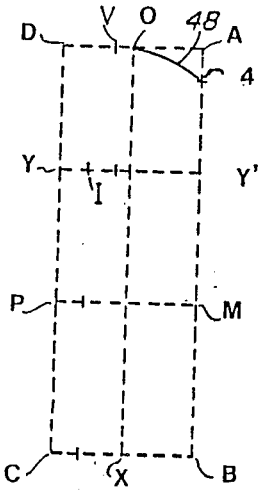

Referring now to the other figures of the drawings, and FIG. 2 initially, a sleeve frame is defined by points A, B, C and D as outlined, with a centre line O—X for the sleeve being marked within the area. A first horizontal line 42 is then provided, the distance of which may be chosen from Table 1 as described hereinafter. Line 42, between two points Y and Y, is then bisected by a point 44. Point 44 is determined by the scale of Table 1, with a second point 46 likewise being designated according to Table 1 on the line 42.

A further point M is likewise designated on the frame, this point being defined by ½ distance of Y—B or 2 cms above, according to the arm length or required configuration. A horizontal line M—P is then completed to the line D—C. A point V then defined approximately 0.5 cm from the centre line O—X on line D—A, which then completes the sleeve frame.

Figure 1:
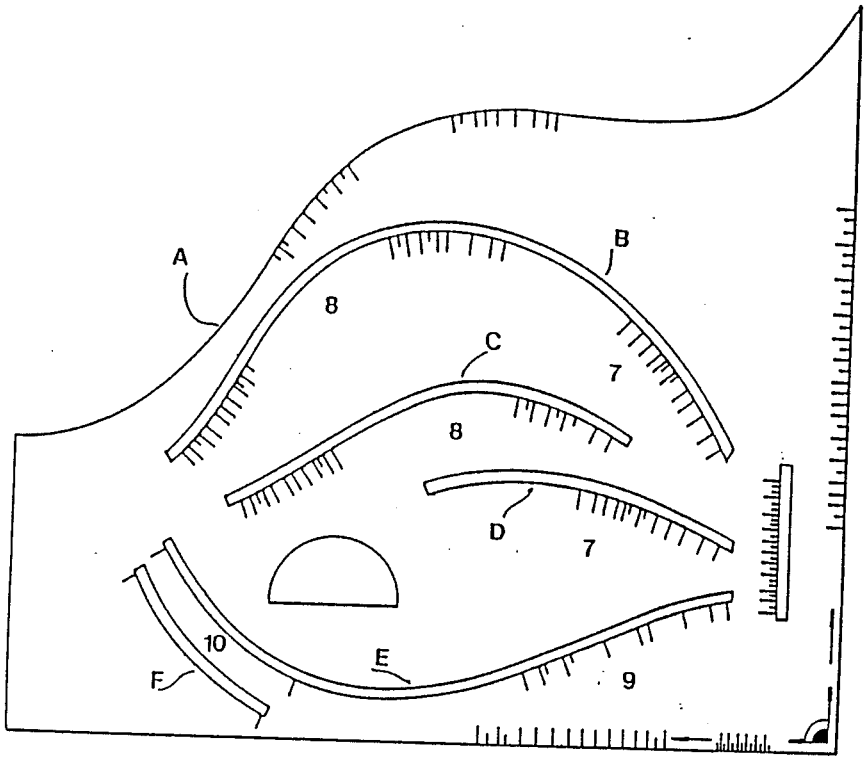
FIG. 1 is a plan view of a template which may be used in constructing the method of the present invention.
Figure 1A:
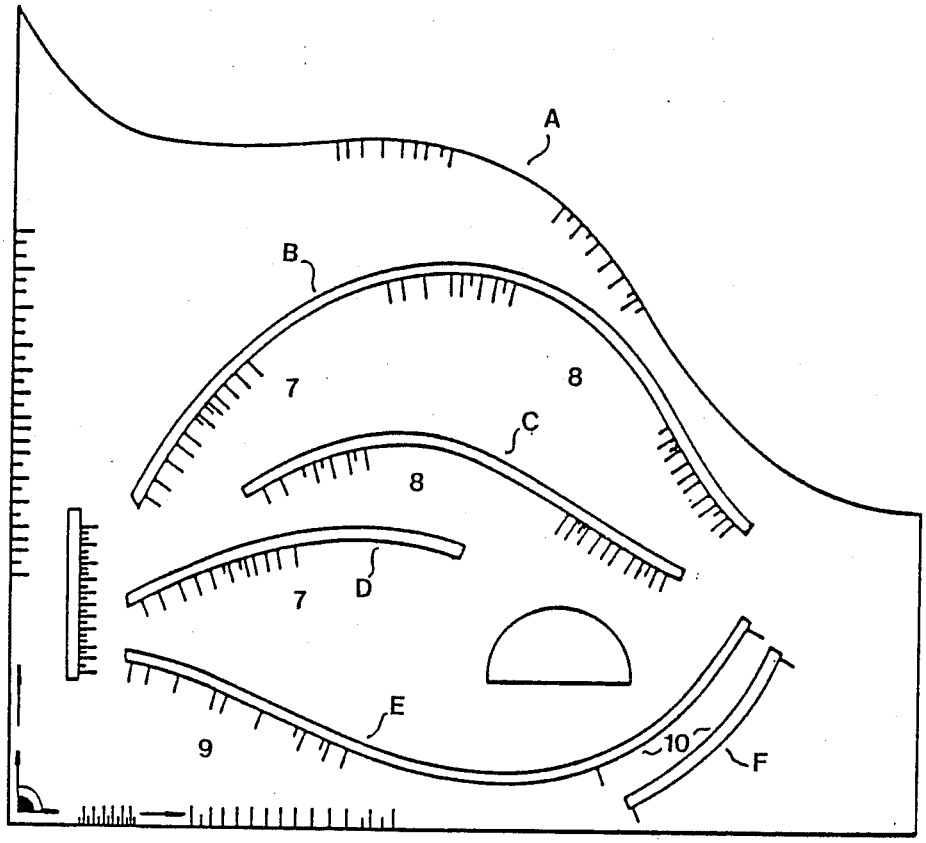
FIG. 1A is a plan view of the reverse portion of the template of FIG. 1.
Figure 4:
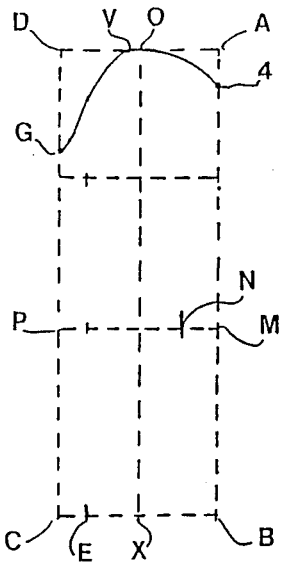
Figure 4A:
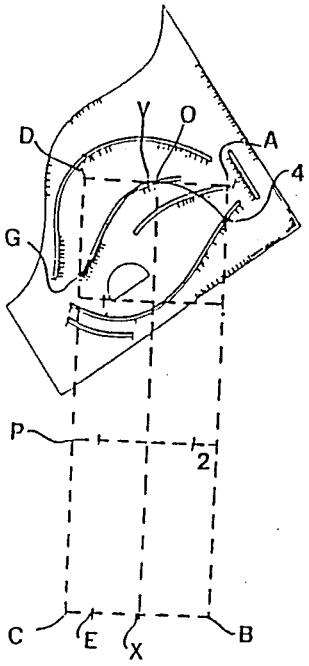
Figure 5A:
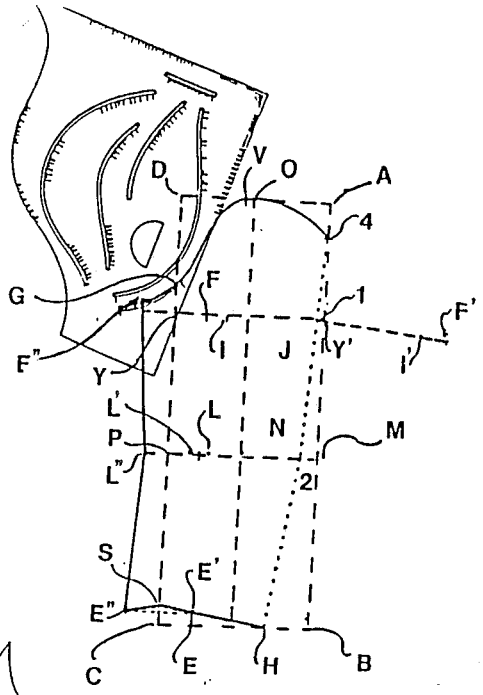
Figure 6A:
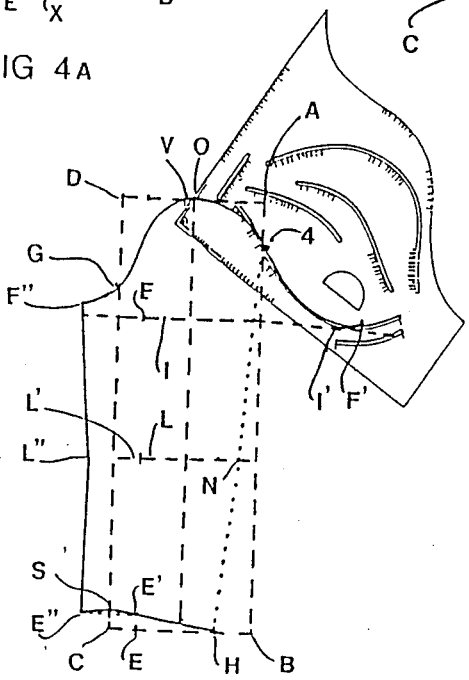

To carry out the method of the present invention, the sleeve frame described above is then utilized in conjunction with e.g., the template of FIGS. 1 and 1A. With reference to FIGS. 4 and 4A, the sleeve cap is constructed using the scale 8 of the template of FIGS. 1 and 1A by choosing a given size, the template permits construction of a line 48 by using the scale 7 to coincide with a chosen size and aligning the same with the Point O shown in FIG. 3. A point 4 is then joined with point O; using the scale 8 to coincide with the chosen size, the upper scale with point V and the same chosen size, of the lower scale for the vertical line D—Y there is thus obtained the point G and the curve is drawn from the point V through G.

Again, employing the template, scale 9 is utilized with the selected size and the point 4 is chosen and the curve 4—I is completed at the point 44.

To complete the preparation of the closed sleeve cap, the curve G—I is prepared using the scale 10 and the point F is aligned vertically by intersecting the curve G—I.

The design of the sleeve is carried on further by determining the point N at approximately 2 cms from point M on the line P—M, and L and L' at 1 cm each from the line F—E on line P—M. The point S is also determined at approximately 1 cm over point C; line SHS—H is determined at approximately 13 cms and point H on line B—C. These measurements will vary depending on the size of the garment being prepared.

The use of the above method, Table 1, presented hereinafter, is suitable for various sizes but this can be varied as will be appreciated by those skilled in the art.

TABLE I

| Sizes | Y - F | Y - I |
|---|---|---|
| 8–10 | 2½ cm | 5 cm |
| 12 | 3 cm | 6 cm |
| 14–38–40–42–44 | 3½ cm | 7 cm |
| 46–48–50–52–54 | 4 cm | 8 cm |

The substrate is then folded along line G—C and employing conventional techniques using reproducing paper or the like (e.g. carbon paper), a tracing is made over the lines G—F—L—E—S. The substrate is then unfolded; in the same manner, the substrate may also be folded along line 4—N and a tracing made of $IFL'N with the resulting substrate paper then opened again. Following that, the substrate is folded along N—H and the drawing traced out along lines N—L—E'—H. The outline of the sleeve may then be prepared following the lines and points E—F'-'—G—O—4—I'—F—W—N—R—H'—H—S—E'.

One aspect of this invention in preparing a tailored open sleeve and thus eliminating the above steps of folding and unfolding, tracing over figures and simplifying the process of obtaining the sleeve pattern directly results in saving time. To achieve this, the front and back portion of the sleeve cap, explained above, may be constructed choosing point N at approximately 2 cm from M; and L and L' at approximately 1 cm from F—E on P—M. The transport point F is made at approximately 0.5 cm over Y (1). Point S is then chosen at approximately 1 cm over C and point H are 13 cms from S on line B—C. The lines (4)—N and N—H are then completed. Both lines will be oblique lines at different angles and point J will be at the intersection of lines (4)—N with the armhole depth determined by line (1)—Y. Commencing at point J, a line is drawn (J—I') perpendicular to the line J—N. Line J—1' is extended by a measurement equal to I—F and point F' is marked at 0.5 cm there above.

Figure 5:
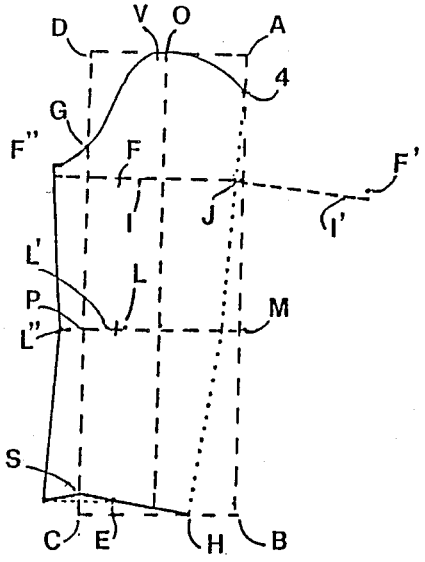

Point Y is then extended to form line (1)—Y using a distance equal to F—Y to obtain point F'' at 0.5 cm above the horizontal from line (1)—Y, and then points G and F'' are joined using scale 10. Horizontal line P—M is extended from points P to L'' a distance equal to P—L'. From point E', which is the intersection of the inclined line H—S with the vertical from E, a further point on the other side of line D—C is formed by transposition, and a horizontal line from point E' is created to extend beyond line D—C by a distance equal from point E' to line E—C with point E'' then being prepared with point S joining point E'' to form line S—E''. Points F''—L''—E'' are then joined (FIG. 5).

Figure 6:
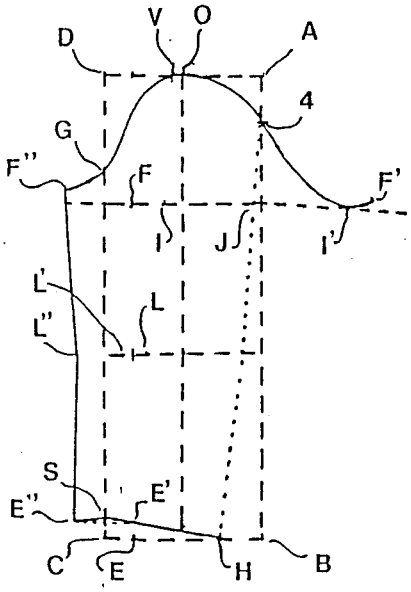

Using scale 9 (FIG. 1A) of the template, the chosen size is aligned with point (4) which is then joined with point I'. Subsequently, scale 10 (FIG. 1A) is then utilized to join points F' and I', (FIG. 6). From point N, line N—W is drawn perpendicular to line N—J and is chosen so as to be equal with line N—L. Likewise, from point N, line N—R is drawn perpendicular to line N—H and equal to line N—L. From point H, line H—H' is drawn perpendicular to line H—N and equal to line H—E' with point F' being joined to point W to form line F'—W and point R to point H' to form line R—H'.

With point W a symmetry to point L in relation to inclination 4N and point R a symmetry to point L in relation to inclination NH and point H' a symmetry to E' in relation to NH.

Figure 7:
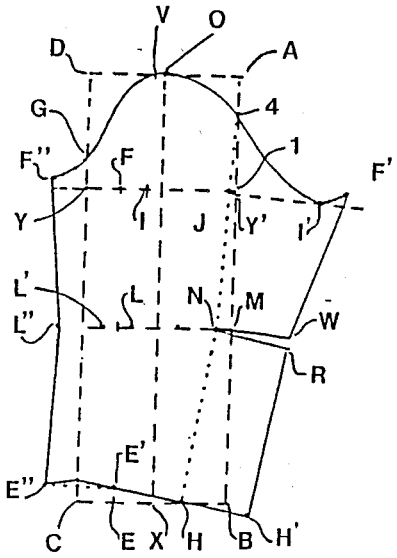

Since lines 4—N and N—H are at relative angles to each other, there will thus result an opening in W—R, equal in width to that of the required dart, (FIG. 7).

Figure 8:
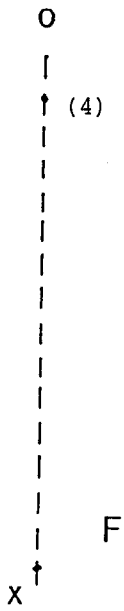
Figure 9:
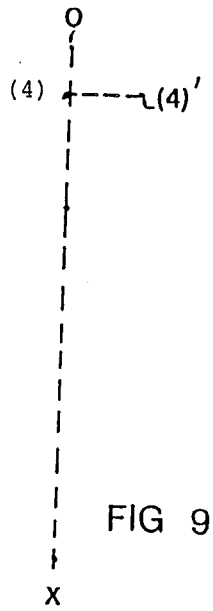

There will now be described a variation for preparing other types of sleeves, and reference will be made to FIGS. 8 and following: A vertical line O—X is created equal to the length of the sleeve with point 0 being the starting point, i.e. the head of the sleeve. With scale 4 a vertical point (4) is created to obtain approximately ⅓ of the armhole depth of the sleeve.

Figure 10:
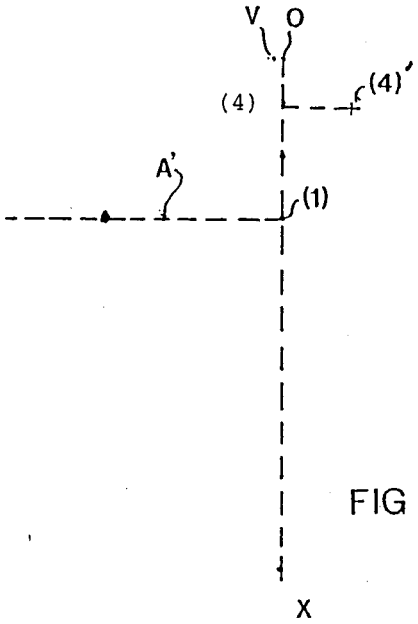
Figure 8A:
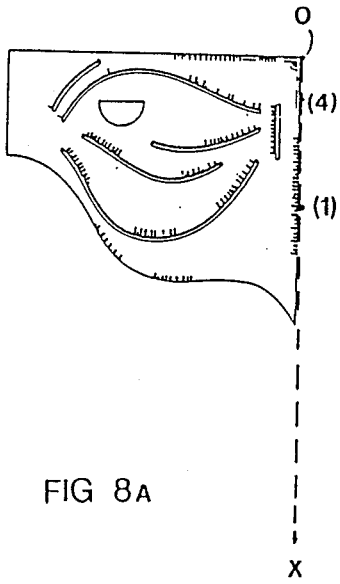
Figure 9A:
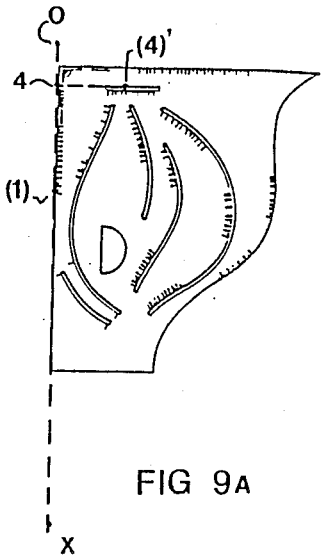
Figure 10A:
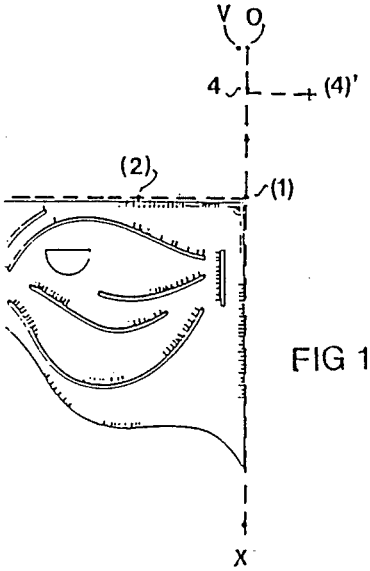
Figure 11:
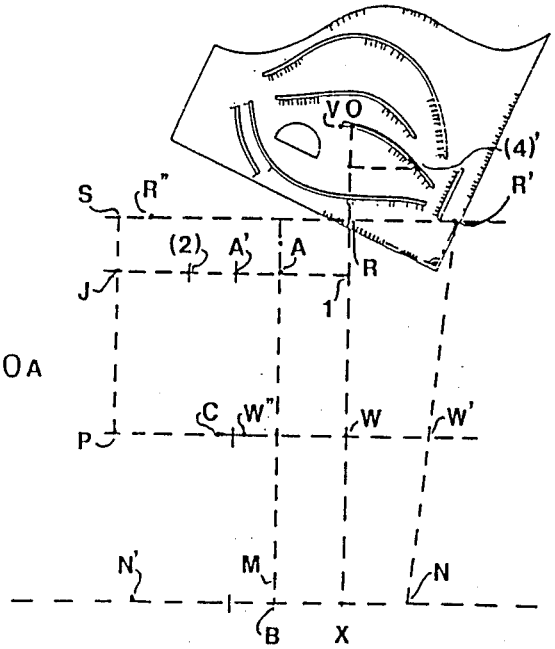
Figure 12:
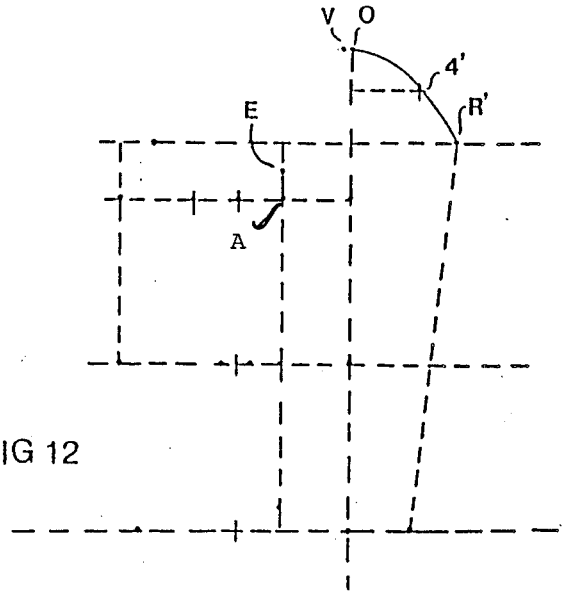
Figure 13:
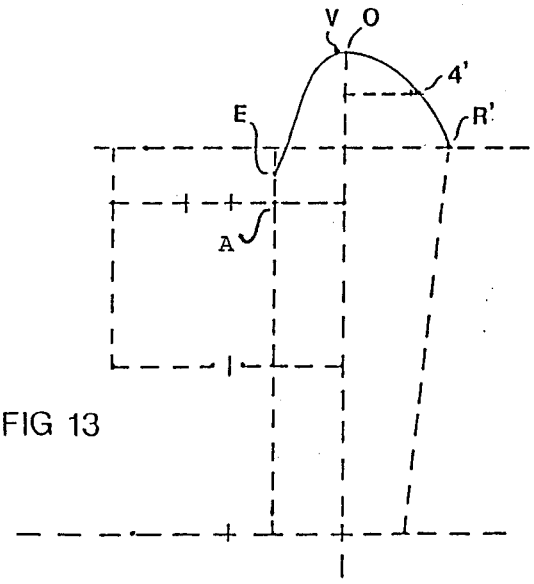
Figure 12A:
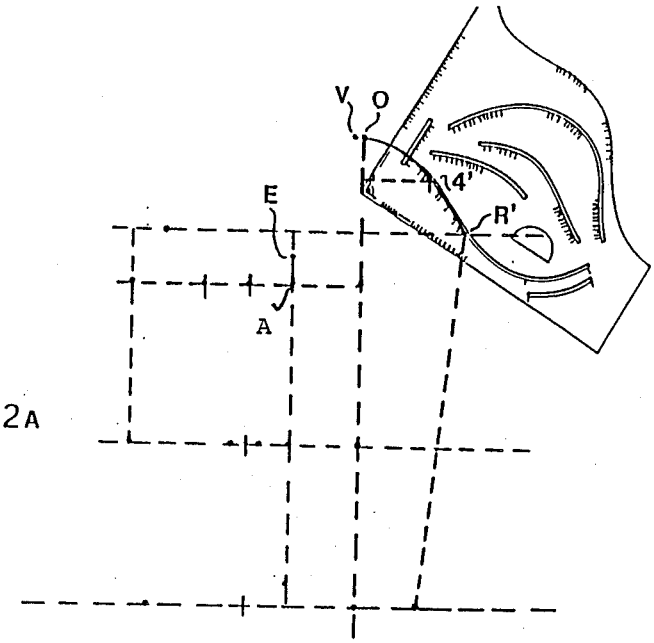
Figure 13A:
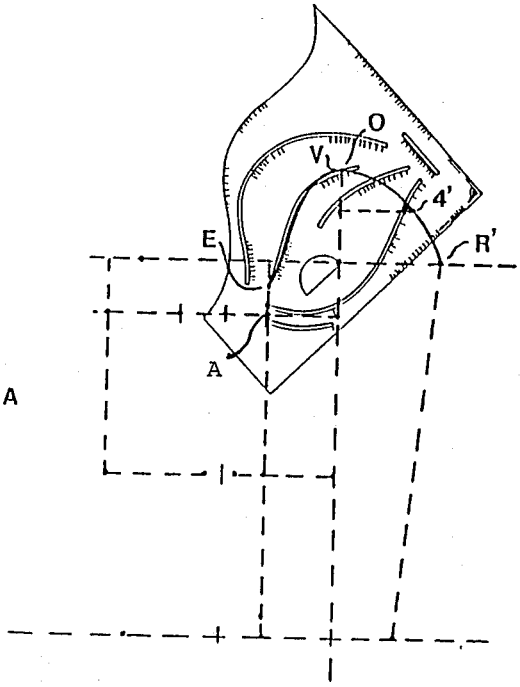
Figure 14:
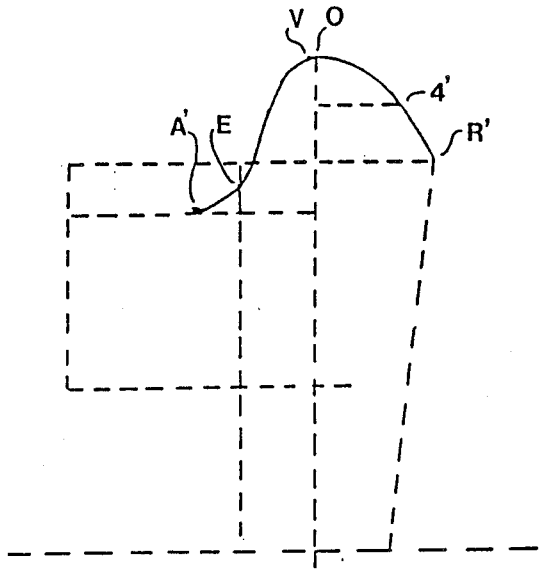
Figure 15:
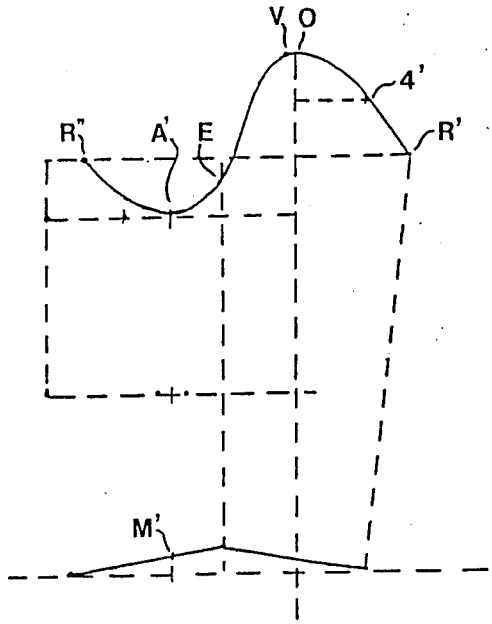
Figure 14A:
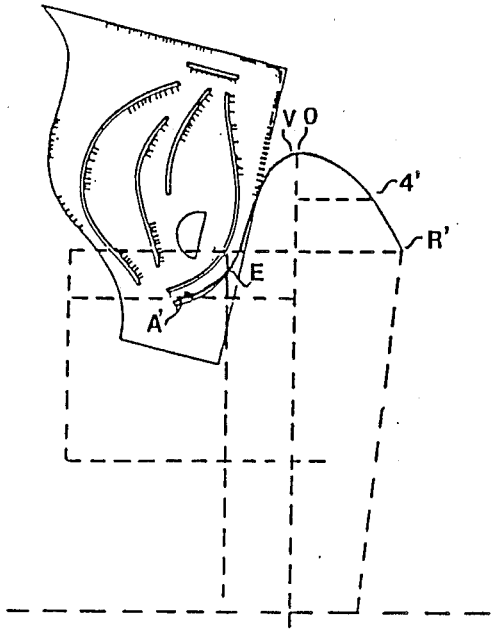
Figure 15A:
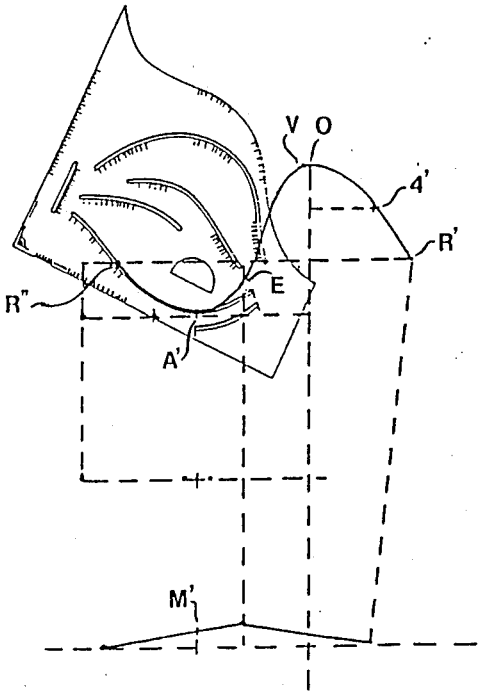
Figure 16:
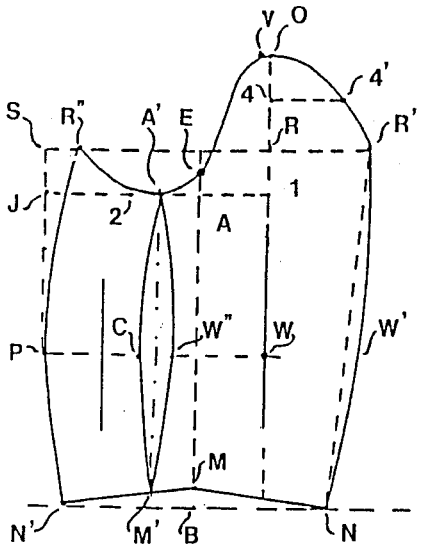
Figure 18:
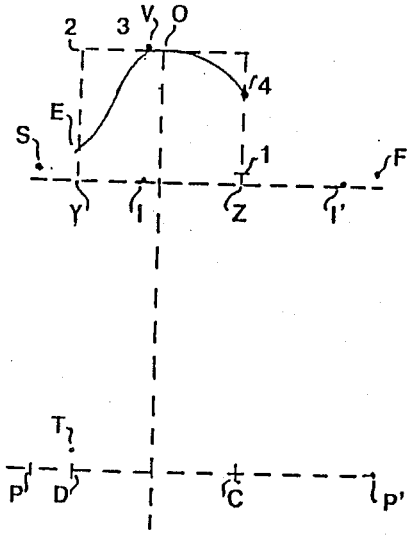

Horizontal to point (4), point (4') is created ¼ of its width using scale 3. Point V is placed ½ cm to the left of point 0, (FIG. 10). On the vertical line O—X there is provided an armhole depth point (1) using scale (1) of the template, for the required sleeve. In some instances, this point may be lowered by 1 cm or more to increase the armhole depth, if required or desired, (FIG. 8). From point (1), a horizontal line of indeterminate length is drawn to the left side of the vertical line O—X. A horizontal point (2) is marked with the use of scale (2), which is ½ the sleeve width plus 1 cm or plus the corresponding slack according to a desired style With the use of scale 7, there is made a curve to the required size at point (4') by joining 0 to (4'), thus obtaining a portion of the back of the sleeve cap. Point A is marked at one half the distance of points (1)-(2) and from point A, a vertical line A—B is traced to meet the horizontal from point X at B. Point M is provided at approximately 3 cms on the vertical line A—B from B and MN=14 cms or equivalent to the required sleeve opening, point N being horizontally located relative to point X. point N' is located from point B at a distance equal to that of line B—N and is then extended on the horizontal line B—N' from point B. From point (2) point J is marked using scale 3 of the sleeves or ¼ of the sleeve width and add 1 cm.

At half the distance between points A and B, or from point O at a length equal to the elbow length from the tip of the shoulder, a horizontal line is provided; on this horizontal line at approximately 2 cms from the vertical line A—B, point W'' and A' is provided at half the distance between points A and (2). Point R is marked at half the distance from line (4)—(1). A horizontal line R—R' is provided which is equal to line (4)—(4') plus the corresponding measurement Y—F, i.e. Table 1 on page 13 which in this case would be e.g. approximately $3\frac{1}{2}$ cm. ($R—R'=(4)—(4')+3\frac{1}{2}$ cms). From point (2), using scale 3 a point J, which is i.e. $\frac{1}{4}$ of the sleeve width and an allowance of e.g. 1 cm is provided.

A vertical line J—S is provided and extended to point P with point S on the horizontal line from line R—R' and point P on the horizontal line W"—C. Curved line (4')—R' is formed using scale 9 and with scale 8, brings together the required size of the upper scale with point V and its lower scale of the size in use with the vertical from A in E. Line E—A' is provided using scale 10 and joined to A—R" using the balance of scale 9 on the reverse side of the template. Points R' and N are then joined in a curve. From point A', a vertical line A'—M' is provided to point M' on M—N'. Points A' and W", and points W" and M' are joined in a curve. From the vertical, a mirror image is made with points A'W"M' and A'C M'. Point R" is marked from point S on the horizontal line R'—R at the same distance as Y—F (Table 1 page 13) and from point R" a curve is traced to point P and a curve from points P and N'.

The diagram outlined by points R",A',E,V-,O,(4'),R',N, M,N',P and R" is the contour of a one piece sleeve pattern with a seam on the back following the curves R'—N and R"—P—N'. The direction O—X is the grain of the fabric when traced onto fabric or made using fabric. If a tapered sleeve at the elbow is required, a dart may be sewn following the curves A'—C—M' and A'—W"—M'. If a two piece sleeve style is desired, then the patterns will use the following contours: for the upper part of a pattern, the grain of the fabric follows line O—X A'E V O (4') R' N M M' W" A'; for the lower part pattern, the straight grain of the fabric follows a vertical position to P C: A'R"P N'M'C A'.

Figure 17:
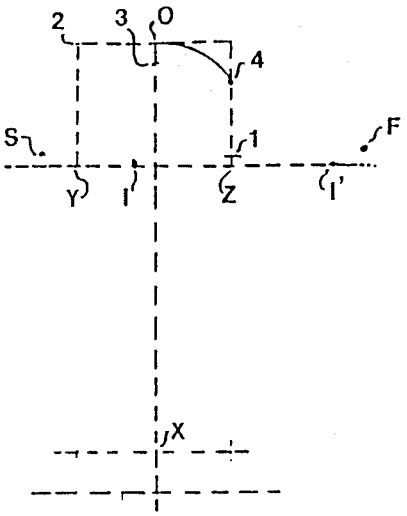
Figure 19:
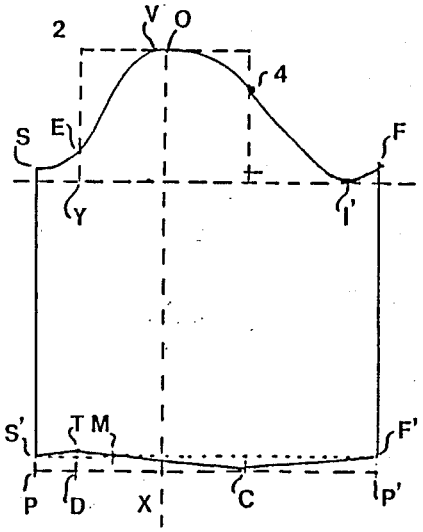

In another aspect a chemisier sleeve for an overcoat or regular straight sleeve of the type described above with a cuff may be utilized. Accordingly, point 4 is marked using template scale (4) and lower scale (1) approximately one cm from point Z, (FIG. 17). One-half the width of the sleeve, using scale (2) together with a 1 cm allowance and one-quarter of the sleeve using scale (3) together with a 0.5 cm allowance is then formed, (FIG. 17). A line O—X is then created passing by point (3) with a length equal to the required sleeve length minus the cuff width, and any allowance desired.

For the construction of a sleeve cap, a perpendicular line is drawn to meet point Y along a horizontal line from point Z. Point Y—I is marked on line Y—Z at a distance from line Y—I approximately 7 cms or as per Table 1 on page 13 according to the desired size. Thereafter, the horizontal line I—Z is extended to I' where Z—I'=Z—I. A point S is marked at a distance equal to approximately half the measurement of Y—I and about 0.5 cm above the horizontal Y—1. Also point F is placed at a distance from I' equal to S Y and about 0.5 cm above the horizontal I' Z. Point V is provided at 0.5 cm from Point O, (see FIG. 18).

To complete the sleeve cap points (4) to O are joined with the use of scale 7 and as well as points V to E with the use of scale 8, and (4) to I' with the use of scale 9 on the reverse side of the template (FIG. 1A) and I' to F with the use of scale 10 on the reverse side of the template and finally point E to S with the use of scale 10.

In connection with the sleeve development, a horizontal line is drawn from X, and from S & F a perpendicular line is drawn to point P and P' on the horizontal line from X. Point D is provided on the horizontal line from X where X D=O (2), point T is marked at approximately 2 cm above point D (X C=X D) and T is joined to C. M is marked on T C at a distance equal to Y S (T M=Y S). From M a horizontal is provided that meets S P in S' and F P' in F'. S' T and C F' are then joined to complete the design of the chemisier sleeve style which is limited within and by the contour of: S'—S—E—V—O—(4)—I'—F—F'—C—T—S'.

With the method and device of the present invention, the most difficult sleeves become easy to do; the present invention provides a way to ease the designing of the most complicated sleeve pattern in a simple way starting from a vertical line, thus eliminating the prior art construction frame. It also permits patterns in a unified system for the simple as well as constructional sleeves reducing the tracing to the simplest expression and allowing the use in functions of X & Y. Consequently the present invention presents the method to be applied to computerised pattern design systems for several sleeve types such as, but not limited to, two piece tailored sleeves, overcoat tailored sleeves, sleeves with one seam, overcoat sleeves with a dart at the elbow and the like of the same category

We claim:

1. In a method of constructing a sleeve, in which an elbow dart is formed inwardly spaced from a side longitudinal line of a length of elongated material having an inclined lower sleeve width at one end thereof, the improvement characterized by:

(i) forming a dart at said apex wherein the arms of said dart form a substantially right angle with
  (a) a line intersecting said apex on said side longitudinal line at the rear sleeve cap and
  (b) said inclined lower sleeve width,
(ii) determining the mounting point of a sleeve underarm seam to a front armhole of a garment,
(iii) forming the underarm sleeve width so as to have a width of said material projecting beyond said line intersecting said apex of (ia) approximately equal to the width of said sleeve width less a distance approximately equal to said mounting point of the sleeve underarm seam with a garment and the side seam of a garment,
(iv) forming an arcuate rear sleeve head between said (ii) and a seam of the sleeve,
(v) increasing the length of said width of the sleeve at the side opposed to (iv) a distance approximately equal to the length of the mounting point of the sleeve underarm seam to a front armhole of a garment and the side seam of a garment, and
(vi) forming an arcuate front sleeve head adapted to meet the rear sleeve head of said sleeve material when the material is joined together.

2. A method as defined in claim 1, wherein said step (ii) is carried out by forming a line projecting beyond said side longitudinal line on said rear sleeve cap substantially right-angles to a line intersecting said apex and a point of said side longitudinal edge of said rear sleeve cap.

3. A method as defined in claim 1, wherein the step of forming an inclined lower sleeve width is carried out by forming a width substantially equal to the width of the sleeve by desired angle of inclination.

4. A method as defined in claim 1, wherein there is included the step of forming a generally arcuately shaped rear sleeve cap outline by forming a line extending inwardly from said side longitudinal line to the upper part of said centre longitudinal line.

5. A method as defined in claim 1, wherein said step of determining approximately the depth of a sleeve cap is carried by determining approximately one-third the length of said armhole depth.

6. A method as defined in claim 1, wherein the step of determining the width of the sleeve is carried out by determining one-half the length of an arm circumference, providing a predetermined allowance.

7. A method as defined in claim 1, wherein said method is carried out directly on a length of material adapted to form a sleeve.

8. A method as defined in claim 1, wherein said method is carried out on a pattern adapted to overlay a length of sleeve material.

9. In a method of forming a sleeve which includes the steps of:

(1) providing a length of elongated material,
(2) determining a center line on said material,
(3) determining a given armhole depth on a center longitudinal line,
(4) determining approximately the depth of the sleeve cap on said center line,
(5) determining approximately one-quarter the sleeve width from the longitudinal center line, from the approximate sleeve cap depth, of the center line,
(6) determining a sleeve width,
(7) forming an arcuately shaped rear sleeve cap outline,
(8) determining a mounting point of the sleeve to the shoulder of the garment,
(9) providing on one side of said longitudinal center line a horizontal line from the armhole depth previously determined on said longitudinal center line,
(10) determining a position on said horizontal center line of approximately one-half sleeve width and optionally any allowance desired therefore and determining on a horizontal plane a point at about half the distance obtained to providing a second longitudinal line from the first point,
(11) providing, at approximately half the distance between the armhole depth and the cap depth previously defined on the center longitudinal line, a horizontal line extending on both sides of said center line,
(12) determining, on one side of said horizontal line, approximately one quarter of the sleeve width plus approximately the distance to accommodate the elbow shape of the body size for the garment,
(13) determining, on the opposite side of the center line and on the same horizontal plane of step 12, approximately 75% of the sleeve width minus a distance equal to the distance added previously to accommodate the elbow shape for the body size of the garment,
(14) determining the elbow height and defining said height by a horizontal line extending on both sides of the longitudinal center line,
(15) defining a sleeve length at the bottom of said longitudinal center line by a horizontal line extending on both sides of said center line,
(16) and optionally, on said, horizontal lines at the bottom and the elbow line, determining approximately 25% the sleeve width,
(17) determining a sleeve opening dimension on the bottom horizontal line, the improvement comprising;
(a) forming an arcuate rear sleeve head between said previously determined elements of steps (5) and (12) to thereby complete an arcuate shaped rear sleeve cap outline described in step (7),
(b) forming an arcuate front sleeve head between said mounting point of step (8) and the previously defined longitudinal line passing at approximately one-quarter of the sleeve width of step (10),
(c) joining the point defined by step (13) and the arcuate line previously formed in step (a) by providing an arcuate line to form the underarm of a sleeve head,
(d) determining approximately 75% of the sleeve width measure at the elbow horizontal line on the left side of said center longitudinal line,
(e) joining the underarm sleeve head described instep (c) to the sleeve opening of step (17) with a curved line passing said point on the elbow horizontal line step (d),
(f) providing a curved line from the rear sleeve head of item (b) to the bottom sleeve opening determined on the right side of said longitudinal center line,
(g) providing a shape of the sleeve opening in an angle with the angle of the apex on the secondary longitudinal line of step (10),
(h) determining approximately 50% of the distance between the sleeve width and said second longitudinal line and providing a longitudinal curved line extending to the bottom of the sleeve opening and spaced at the elbow line or with its maximum curve at the elbow line,
(i) next is nearer this longitudinal curved line provided in item (h), and
(j) defining two-piece tailored sleeve by the resulting contours and the longitudinal curved line of steps (h) and (i).

10. A method as defined in claim 9, wherein said step (5) by determining the approximate sleeve cap depth to a first side of said center line.

11. A method as defined in claim 9, wherein said step (9) is carried out by providing said horizontal line on a second side of said center line.

12. A method as defined in claim 9, wherein said step (16) is carried out by determining approximately 25% of the sleeve width on a second side of said center line.

13. A method as defined in claim 9, wherein said method is carried out directly on a length of material adapted to form a sleeve.

14. A method as defined in claim 9, wherein said method is carried out on a pattern adapted to overlay a length of sleeve material.

15. A method as defined in claim 9, wherein said step (7) is carried out using a garment drafting device comprising a base material having at least one curve-defining means therein, said curve-defining means being selected from the group of:

$$y = 6.1 + 0.54286x - 1.5 \sin\left[\frac{360}{\pi}(x + 0.75)\right], \quad \text{(a)}$$

wherein x has a value from 0 to 15, $$y = 31.2913 - 27.4913x + 10.6253x^2 - 1.9332x^3 + 0.18456x^4 - 8.9654*10^{-3}x^5 + 1.743*10^{-4}x^6, \quad \text{(b)}$$

wherein x has a value from 3 to 13.3, $$y = 12.1238 - 5.5122x + 1.2887x^2 - 0.1123x^3 + 3.277*10^{-3}x^4, \quad \text{(c)}$$

wherein x has a value of from 4 to 11.5, $$y=-2.95705+1.6279x-0.08334x^2, \quad \text{(d)}$$

wherein x has the value of from 7.8 to 13.5, $$y=12.9803-5.5719x+1.0685x^2-0.11236x^3+6.5767x^4\ 10^{-3}-1.5968x^5\ 10^{-4}, \quad \text{(e)}$$

wherein x has a value of from 2.9 to 13.5, and $$y=9.0697-3.3274x+0.32514x^2 \quad \text{(f)}$$

wherein x has a value of from 2.3 to 4.9.

* * * * *